United States Patent [19]

Watanabe

[11] Patent Number: 4,993,005

[45] Date of Patent: Feb. 12, 1991

[54] POWER SUPPLY SYSTEM FOR LUMINOUS HANDS

[75] Inventor: Isato Watanabe, Tokyo, Japan

[73] Assignee: Seikosha Co., Ltd., Tokyo, Japan

[21] Appl. No.: 541,562

[22] Filed: Jun. 21, 1990

[30] Foreign Application Priority Data

Jun. 29, 1989 [JP] Japan ..... 1-163175

[51] Int. Cl.[5] ..... G04B 19/32

[52] U.S. Cl. ..... 368/226; 368/238

[58] Field of Search ..... 368/67, 80, 226, 228, 368/238

[56] References Cited

U.S. PATENT DOCUMENTS 2,655,783 10/1953 Uschkamp ..... 368/226

3,079,748 3/1963 Hultquist ..... 368/226

*Primary Examiner*—Vit W. Miska

*Attorney, Agent, or Firm*—Jordan and Hamburg

[57] ABSTRACT

A power supply system for luminous hands wherein an hour and a minute hand have electroluminescence elements and a second hand has a light-emitting diode. The power supply system comprises a drive signal generator for generating a mixed signal consisting of a high-frequency signal and a low-frequency signal. An hour hand brush conductor between a fixed member and the hour hand receives the mixed signal. An hour hand filter passes only the low-frequency signal and sends it to the electroluminescence element of the hour hand. A minute hand brush conductor device placed between the hour hand and the minute hand receives the mixed signal from said hour hand brush conductor device. A minute hand filter passes only the low-frequency signal of the mixed signal and sends the low-frequency signal to the electroluminescence element of the minute hand. A rotary transformer between the minute hand and the second hand transfers the mixed signal from the minute hand brush conductor device to the light-emitting diode of the second hand. When the second hand alternatively has an electro-luminescence element, a converter is provided to convert the high-frequency signal to a low-frequency signal and send this low-frequency signal to the electroluminescence element of the second hand.

8 Claims, 5 Drawing Sheets

POWER SUPPLY SYSTEM FOR LUMINOUS HANDS

FIELD OF THE INVENTION:

The present invention relates to a power supply system for luminous hands.

BACKGROUND OF THE INVENTION:

The applicant of the present application has disclosed a power supply device for a load on a timing device hand in Japanese Patent Application No. 63-233974. That device is constructed as follows. Two annular conductors are located below a hand and arranged in concentric relation therewith. A pair of conductors are attached to the lower surface of the hand and have contact segments slidable on the two annular conductors. The annular conductors are connected to an external circuit, and the conductors are connected to a load on the hand.

In this device, when electric power is supplied from the external circuit to the two annular conductors, the electric power is transferred to the pair of conductors by the contact segments slidable on the annular conductors, and further supplied to the load on the hand.

With such a brush conductor device, when the contact segments are slidably moved on the annular conductors, they cause frictional resistance to the rotation of the hand. An attempt can be made to adjust the pressure under which the contact segments are in contact with the annular conductors, to reduce such resistance. However, this may deteriorate the electrical connection therebetween.

Japanese Patent Application No. 63-331196 discloses a power supply device for the load of a hand that is intended to solve such problems of a brush conductor device. The power supply device uses a rotary transformer wherein a first coil is mounted to the lower surface of the hand, and a second coil is located downwardly and close to the first coil. Electric power is supplied from an external power source to the second coil to cause the first coil to produce an electromotive force. The power is then supplied from the first coil to the load on the hand.

The device is applied to a timepiece. Power is supplied from the external power source to an hour hand and a minute hand through a brush conductor device and to a second hand through the rotary transformer so as to cause electroluminescence elements on the hour, minute, and second hands to emit light.

It should be noted that the electroluminescence elements should be driven by a low-frequency signal to increase the life of the element, and that the rotary transformer should be driven by a high-frequency signal for improved efficiency of transfer of electric energy. If the high-frequency signal is fed to the electroluminescence element from an external power source, it shortens the life of the electroluminescence element. Also, if the low-frequency signal is fed to the rotary transformer, it deteriorates the efficiency of transfer of electric energy to the second hand.

SUMMARY OF THE INVENTION:

Accordingly, it is an object of the present invention to provide a power supply system for luminous hands which allows hour, minute and second hands to constantly emit light and which will not shorten the life of the electroluminescence elements.

According to the present invention, a power supply system for luminous hands of a timepiece, wherein hour and minute hands have electroluminescence elements and a second hand has a light-emitting diode, comprises drive signal generating means for generating a mixed signal. The mixed signal includes a high-frequency signal and a low-frequency signal. An hour hand brush conductor device is placed between a fixed member and the hour hand and receives the mixed signal. An hour hand filter passes only the low-frequency signal of the mixed signal sent to said hour hand brush conductor device and sends this low-frequency signal to the electroluminescence element of the hour hand. A minute hand brush conductor device is placed between the hour hand and the minute hand and receives the mixed signal from said hour hand brush conductor device. A minute hand filter passes only the low-frequency signal of the mixed signal sent to said minute hand brush conductor device and sends the low-frequency signal to said electroluminescence element of the minute hand. A rotary transformer is provided between the minute hand and the second hand. The rotary transformer transfers the mixed signal from said minute hand brush conductor device to the light-emitting diode of the second hand.

When the second hand alternatively has an electroluminescence element in lieu of the light-emitting diode, a converter is provided to convert the high-frequency signal from the rotary transformer to a low-frequency signal and send the same to the electroluminescence element of the second hand.

In the present invention, the mixed signal is sent to the hour hand and the minute hand via the brush conductor device. Only the low-frequency signal is fed through the filters to the electroluminescence elements of the hour hand and the minute hand so as to cause the electroluminescence elements to emit light. Since the electroluminescence elements are driven by the low-frequency signal, their life is increased.

The mixed signal is then sent to the rotary transformer. The rotary transformer is efficiently driven by the high-frequency signal of the mixed signal. The high-frequency signal is then fed to the light-emitting diode so as to cause the light-emitting diode to emit light.

When the second hand has an electroluminescence element, the high-frequency signal from the rotary transformer is converted to a low-frequency signal by the converter and is, thereafter, fed to the electroluminescence element of the second hand. The electroluminescence element is thus driven by the low-frequency signal. This increases the life of the electroluminescence element.

BRIEF DESCRIPTION OF THE DRAWINGS:

Embodiments of the present invention will now be described with reference to the accompanying drawings, in which.

Figure 1:
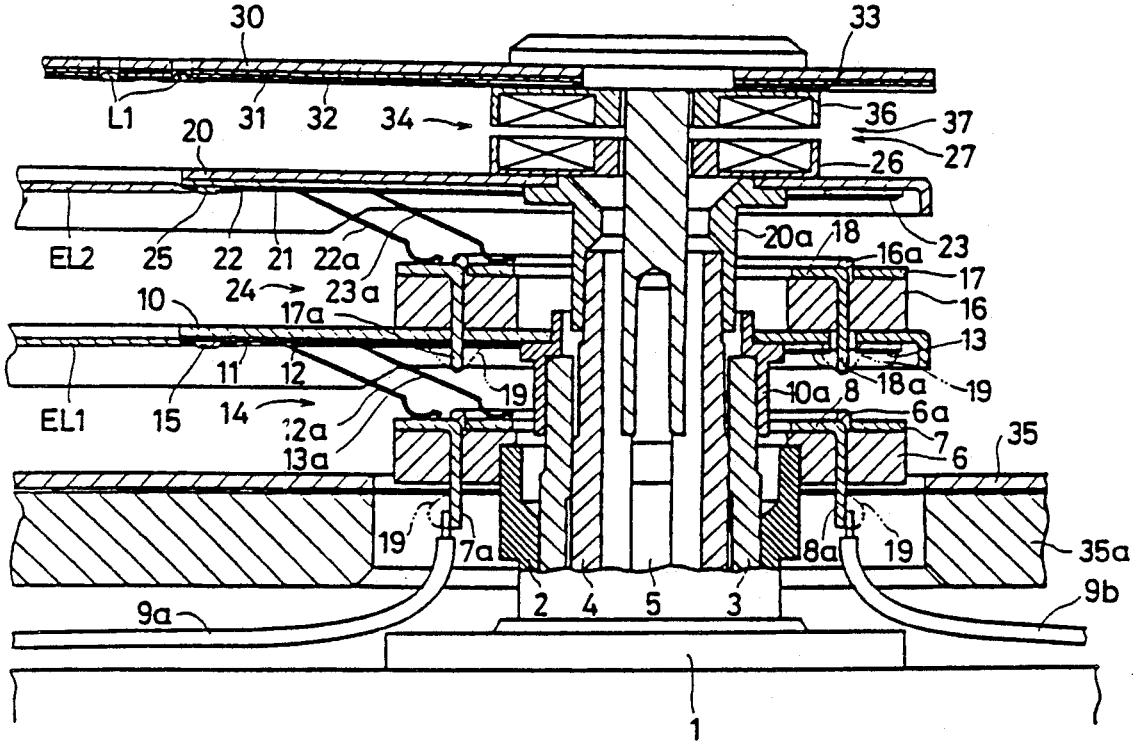
FIG. 1 is a cross section of a portion of a timing device employing the present invention.

DESCRIPTION OF THE PREFERRED EMBODIMENTS:

As shown in FIG. 1, a timepiece movement 1 has a fixed bushing 2 through which an hour hand shaft 3, a minute hand shaft 4 and a second hand shaft 5 extend. A fixed receiver 6 is fit around the upper end of the bushing 2. An annular protrusion 6*a* is formed on the upper surface of the fixed receiver 6, concentrically with the axis of rotation of the hands.

Two annular fixed conductors 7 and 8 are mounted radially outwardly and inwardly, respectively, of the annular protrusion 6*a* on the upper side of the receiver 6. The fixed conductors 7 and 8 partly extend downwardly through the fixed receiver 6 to provide L-shaped connecting members 7*a* and 8*a* connected to lead wires 9*a* and 9*b* by solder 19.

Figure 2:
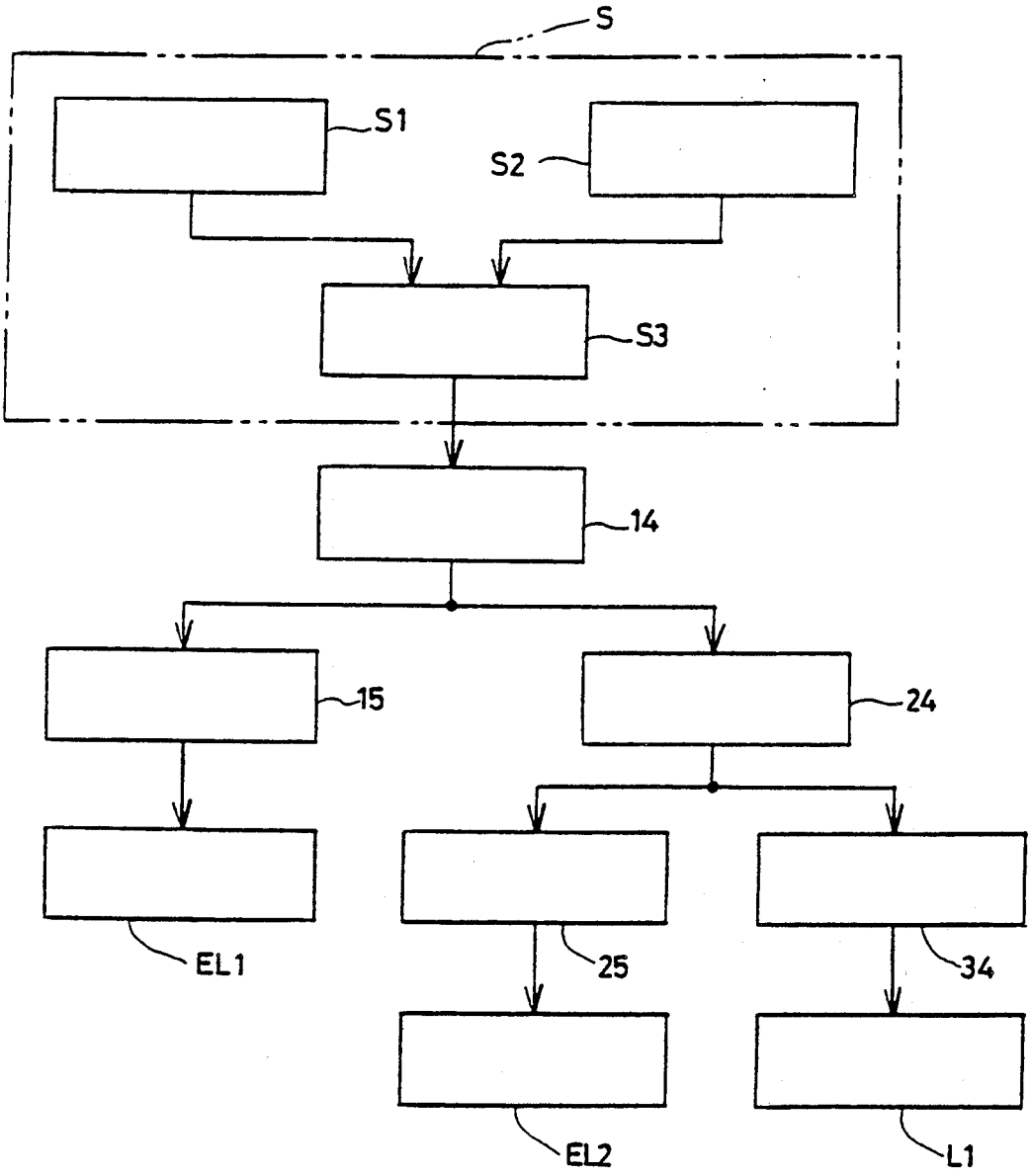
FIG. 2 is a flow diagram of the system of the invention.

A mixed signal S3 (see FIG. 2), which includes a high-frequency signal S1 and a low-frequency signal S2, is fed from a drive signal generating means S to the lead wires 9*a* and 9*b*.

Figure 3:
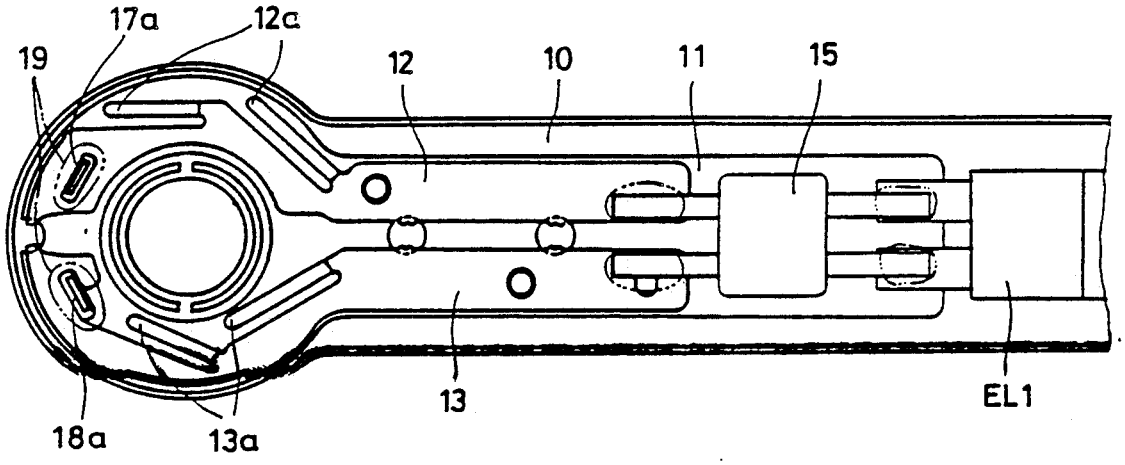
FIG. 3 illustrates the hour hand of FIG. 1.

An hour hand 10 is fixed to the hour hand shaft 3 above the fixed receiver 6. As shown in FIG. 3, two conductors 12 and 13 are secured to the lower surface of the hour hand 10 via insulating plate 11, and include contact segments 12*a* and 13*a*, respectively. The contact segments 12*a* and 13*a* are slidably movable on the fixed conductors 7 and 8 and rotatable about the axis of rotation of the hour hand 10.

With an hour hand brush conductor device 14 thus constructed, electric power is supplied from the conductors 12 and 13 to electroluminescence element ELl through an hour hand filter 15. The filter 15 is a low-pass filter that receives the mixed signal S3 and passes only the low-frequency signal S2.

A receiver 16 is fixedly mounted to the upper surface of the hour hand 10 and is identical in structure to the fixed receiver 6. Two annular conductors 17 and 18 are mounted on the receiver 16 outside and inside, respectively, of a protrusion 16*a*. Two connecting members 17*a* and 18*a* extend downwardly through the receiver 16 and are connected to the conductors 12 and 13, respectively, by solder 19. A minute hand 20 is fixed to the shaft 4 above the hour hand 10. A pair of conductors 22 and 23 are secured to the lower surface of the minute hand 20 via an insulating plate 21 and are identical in structure to the conductors 12 and 13. The conductors 22 and 23 have contact segments 22*a* and 23*a* slidable on the annular conductors 17 and 18 of the receiver 16.

With a minute hand brush conductor device 24 thus constructed, electric power is supplied from the conductors 22 and 23 to electroluminescence element EL2 through a minute hand filter 25. Like the hour hand filter 15, the filter 25 is a low-pass filter.

A coil bobbin 26 is made from magnetic materials and fixed to the upper surface of the minute hand 20 concentrically with the axis of rotation of the minute hand 20. A lead wire is wound around the coil bobbin 26 to provide a coil 27 for the minute hand. The coil 27 is electrically connected to the conductors 22 and 23. A second hand 30 is fixed to the shaft 30 above the minute hand 20. A coil bobbin 36 is made from magnetic materials and is fixed to the lower surface of the second hand 30, facing closely to the coil bobbin 26. A lead wire is wound around the coil bobbin 36 to provide a coil 37 for the second hand.

With a rotary transformer 34 thus constructed, two conductors 32 and 33 are attached to the lower surface of the second hand 30 through an insulating plate 31. Electric power is supplied from the coil 37 to a light-emitting diode L1 through the conductors 32 and 33.

The hour hand 10, the minute hand 20 and the second hand 30 are fixed to the shafts 3, 4 and 5 via pipes 10*a*, 20*a* and 30*a*, respectively, and are rotatable above a dial 35 fixed to a dial receiver 35*a*.

The movement 1 drives the hour hand 10, the minute hand 20 and the second hand 30 so as to display the time. The mixed signal S3 supplied from the drive signal generating means S passes through the lead wires 9*a* and 9*b*, the annular fixed conductors 7 and 8, the contact segments 12*a* and 13*a*, the conductors 12 and 13, and only the low-frequency signal S2 is applied to the electroluminescence element ELl through the filter 15. The electroluminescence element ELl is driven by the low-frequency signal S2 to lengthen its life.

The mixed signal S3 is then applied to the filter 25 through the conductors 12 and 13 and the annular conductors 17 and 18, and the conductors 22 and 23. Only the low-frequency signal S3 is fed to the electroluminescence element EL2 by the filter 25. In this way, the electroluminescence element EL2 also has a longer life.

When alternating current is provided to the coil 27 through the conductors 22 and 23, the coil 37 produces an electromotive force by electromagnetic induction. The high-frequency signal S1 of the mixed signal S3 is efficiently transmitted through the conductors 32 and 33 to the light-emitting diode L1 by the rotary transformer 34.

Figure 4:
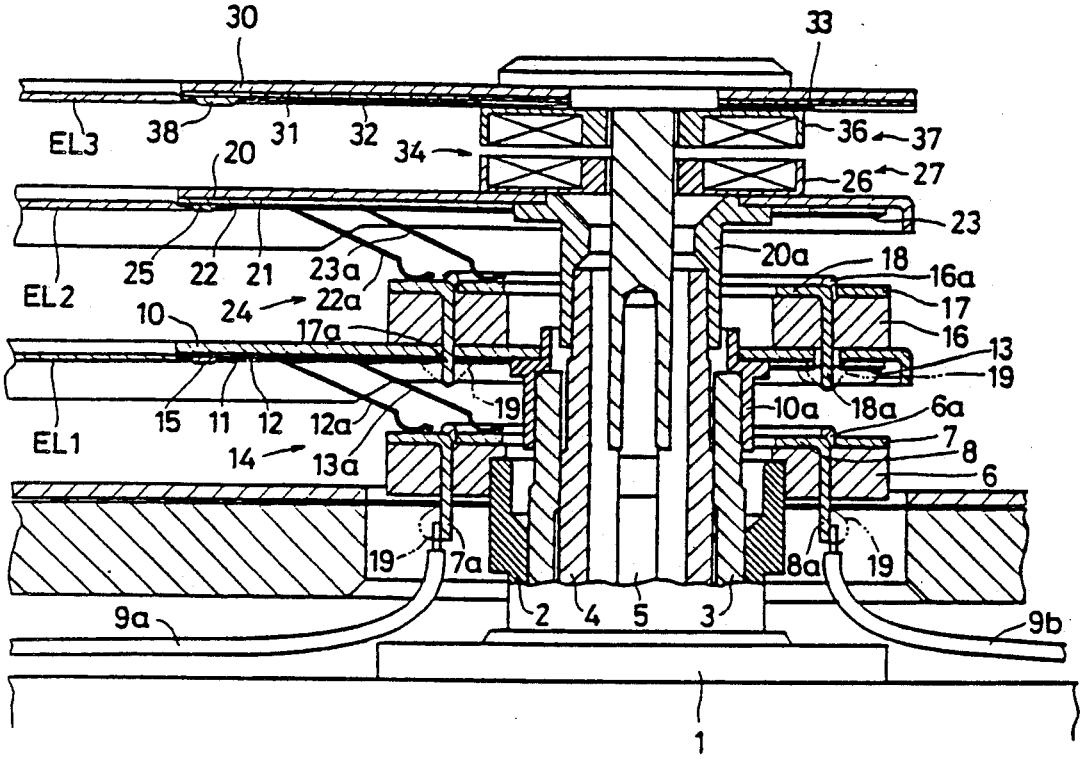
FIG. 4 is a cross section of a portion of a modified timing device.
Figure 5:
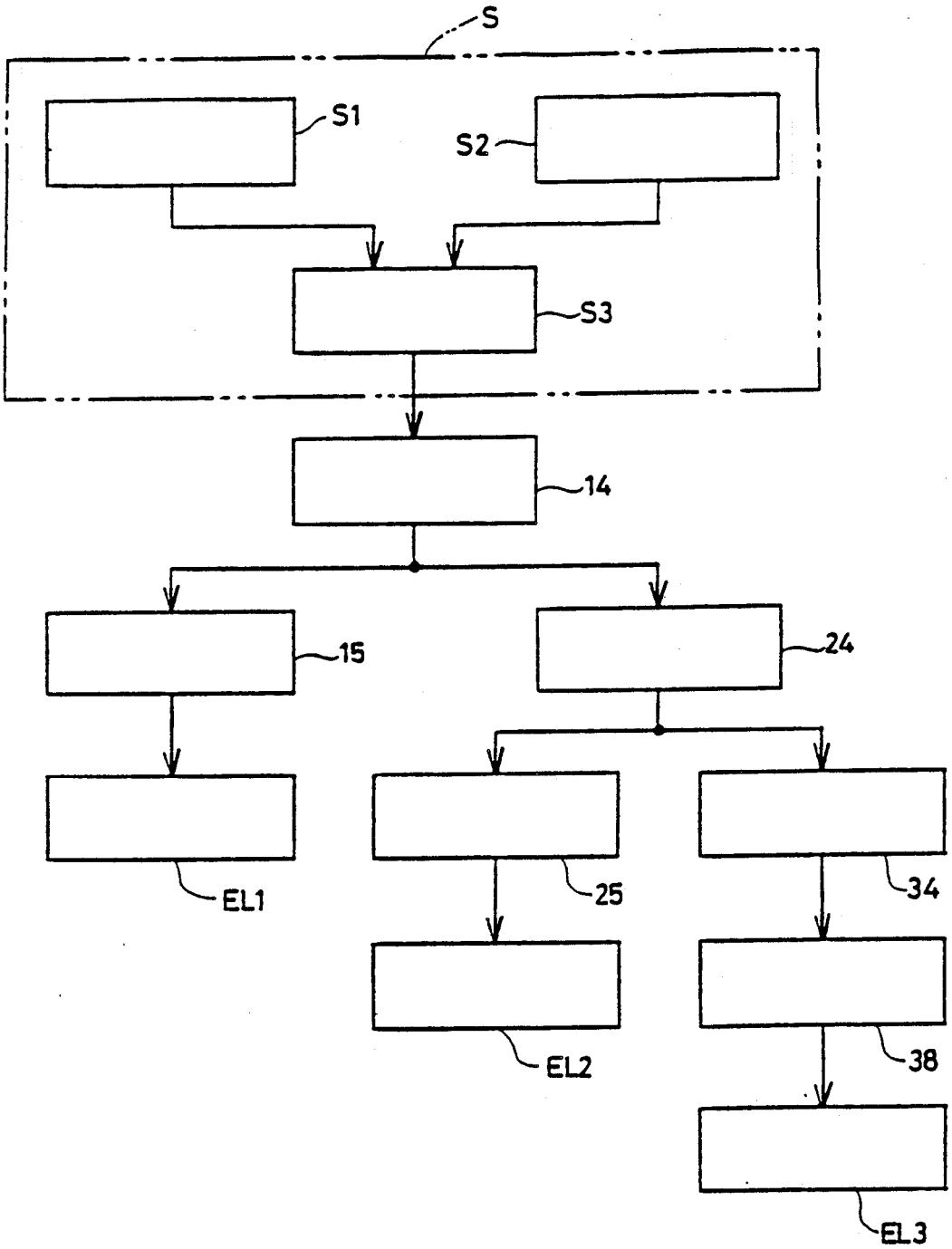
FIG. 5 is a flow diagram of the system of FIG. 4.

FIGS. 4 and 5 show another embodiment of the present invention.

As in the first embodiment, the mixed signal S3, which is generated by the drive signal generating means S, is sent to the hour hand 10 by the brush conductor device 14. Only the low-frequency signal S2 is sent to the electroluminescence element EL1 through the filter 15. The mixed signal S3, which is sent to the minute hand 20 through the brush conductor device 24, is supplied to the filter 25, whereby only the low-frequency signal S2 is sent to the electroluminescence element EL2. On the other hand, the high-frequency signal S1 of the mixed signal S3 is supplied to the second hand 30 by the rotary transformer 34.

In the second embodiment, the second hand 30 has an electroluminescence element EL3 and a converter 38. The coil 37 of the rotary transformer 34 is connected to the converter 38 through the conductors 32 and 33, which is in turn connected to the electroluminescence element EL3. With this arrangement, the high-frequency signal S1, which is sent to the second hand 30 by the rotary transformer 38, is converted to a low-frequency signal by the converter 38, and thereafter, is supplied to the electroluminescence element EL3. This lengthens the life of the electroluminescence element.

In the present invention, as stated above, the electroluminescence elements of the hour and minute hands or the hour, minute, and second hands are driven by the low-frequency signal to lengthen the lives of the electroluminescence elements. The high-frequency signal is used to improve the efficiency of transfer of electric power by the rotary transformer. This results in the rise of reliability of light-emitting by the second hand. Power can be supplied to the second hand under a non-contact condition. Thus, the second hand can be driven by a low torque.

Although the present invention has been described through specific terms, it should be noted here that the described embodiments are not necessarily exclusive and that various changes and modifications may be imparted thereto without departing from the scope of the invention, which is limited solely by the appended claims.

What I claim is:

1. A power supply system for luminous hands of a timepiece having hour and minute hands with electroluminescence elements and a second hand having a light-emitting diode, comprising:

drive signal generating means for generating a mixed signal including a high-frequency signal and a low-frequency signal;

a fixed member;

an hour hand brush conductor device placed between said fixed member and said hour hand and connected to receive said mixed signal;

an hour hand filter for passing only said low-frequency signal of the mixed signal sent to said hour hand brush conductor device and connected to send said low-frequency signal to said electroluminescence element of the hour hand;

a minute hand brush conductor device placed between said hour hand and said minute hand and connected to receive said mixed signal from said hour hand brush conductor device;

a minute hand filter for passing only said low-frequency signal of the mixed signal sent to said minute hand brush conductor device and connected to send said low-frequency signal to said electroluminescence element of the minute hand; and a rotary transformer provided between said minute hand and said second hand, said rotary transformer being connected to transfer said mixed signal from said minute hand brush conductor device to said light-emitting diode of the second hand.

2. A power supply system for luminous hands of a timepiece having hour, minute, and second hands with electroluminescence elements, comprising:

drive signal generating means for generating a mixed signal including a high-frequency signal and a low-frequency signal;

a fixed member;

an hour hand brush conductor device placed between said fixed member and said hour hand for receiving said mixed signal;

an hour hand filter for passing only said low-frequency signal of the mixed signal sent to said hour hand brush conductor device and connected to send said low-frequency signal to said electroluminescence element of the hour hand;

a minute hand brush conductor device placed between said hour hand and said minute hand and connected to receive said mixed signal from said hour hand brush conductor device;

a minute hand filter for passing only said low-frequency signal of the mixed signal sent to said minute hand brush conductor device and connected to send said low-frequency signal to said electroluminescence element of the minute hand;

a rotary transformer provided between said minute hand and said second hand and connected to receive said mixed signal from said minute hand brush conductor device; and a converter for converting said high-frequency signal transferred through said rotary transformer to a low-frequency signal and connected to send said last-mentioned low-frequency signal to said electroluminescence element of the second hand.

3. A power supply system for a timepiece having hour, minute and second hands rotatable about a common axis, and illumination elements on said hour, minute and second hands, said system comprising:

a drive signal generator for generating a mixed signal that includes a signal of a first frequency and a signal of a second frequency that is higher than said first frequency, a pair of conductors on each of said hands, first and second sliding brush means rotatable about said axis for applying said mixed signal to said conductors of said hour and minute hands, first and second low-pass filter means on said hour and minute hands connected to pass substantially only signals of said first frequency to the illumination element of the respective hand;

a rotary transformer having a primary winding and a secondary winding;

means coupling said primary winding to said drive signal generator for receiving said mixed signal;

and means coupling said secondary winding to said illumination element of said second hand.

4. The power supply system of claim 3, wherein said first sliding brush means comprises a fixed conductor coupled to said drive signal generator, and sliding contacts on said hour hand arranged to slidingly contact said fixed conductor, and wherein said second sliding brush means comprises contact means on said hour hand connected to the conductors thereon, and sliding contacts on said minute hand arranged to slidingly contact said contact means.

5. The power supply system of claim 3, wherein said illumination elements on said hour and minute hands are electroluminescent elements.

6. The power supply system of claim 3, wherein said primary winding is mounted on said minute hand and connected to the conductors thereon.

7. The power supply system of claim 3, wherein said illumination element on said second hand is an LED, and said means coupling said secondary winding comprises means applying the output of said secondary winding to said LED without frequency conversion.

8. The power supply system of claim 3, wherein said illumination element on said second hand is an electroluminescent element, and said means coupling said secondary winding comprises frequency converter means for converting signals from said secondary winding to a frequency lower than said second frequency for application to said electroluminescent element of said second hand.

* * * * *